US010247416B2

(12) United States Patent
Munsterhuis et al.

(10) Patent No.: US 10,247,416 B2
(45) Date of Patent: Apr. 2, 2019

(54) METHOD FOR OPERATING A GAS BURNER

(71) Applicant: Honeywell Technologies Sarl, Rolle (CH)

(72) Inventors: Wim Munsterhuis, Dalen (NL); Gerrit Jan Baarda, Emmen (NL); Piet Blaauwwiekel, Sleen (NL); Frank Van Prooijen, Sleen (NL); Gerwin Langius, Hardenberg (NL); Albert Hietkamp, Emmen (NL)

(73) Assignee: Honeywell Technologies Sarl, Rolle (CH)

( * ) Notice: Subject to any disclaimer, the term of this patent is extended or adjusted under 35 U.S.C. 154(b) by 557 days.

(21) Appl. No.: 15/077,432

(22) Filed: Mar. 22, 2016

(65) Prior Publication Data

US 2016/0281984 A1 Sep. 29, 2016

(30) Foreign Application Priority Data

Mar. 23, 2015 (EP) ..... 15160313

(51) Int. Cl.
*F23N 5/00* (2006.01)
*F23N 1/00* (2006.01)
(Continued)

(52) U.S. Cl.
CPC ..... *F23N 5/003* (2013.01); *F23N 1/002* (2013.01); *F23N 1/022* (2013.01); *F23N 5/12* (2013.01);
(Continued)

(58) Field of Classification Search
CPC ..... F23N 1/002; F23N 1/022; F23N 2027/20; F23N 2033/08; F23N 2900/05181; F23N 5/003; F23N 5/12
See application file for complete search history.

(56) References Cited

U.S. PATENT DOCUMENTS 2,815,175 A 12/1957 Swenson
2015/0247639 A1 9/2015 Lovascio et al.

FOREIGN PATENT DOCUMENTS

AT 510002 1/2012
EP 0424358 4/1991
(Continued)

OTHER PUBLICATIONS

Extended European Search Report for EP Application No. 15160313.1-1602 dated Sep. 25, 2015.

*Primary Examiner* — Kenneth Rinehart
*Assistant Examiner* — Logan Jones
(74) *Attorney, Agent, or Firm* — Seager, Tufte & Wickhem LLP

(57) ABSTRACT

In a modulating gas burner, the mixing ratio of a gas/air mixture is controlled over a modulation range of the gas burner by a pneumatic controller. During burner on phases, the combustion quality is monitored via a combustion quality sensor. The combustion quality is used to detect tolerances of the pneumatic controller and/or a potentially changing behavior of the pneumatic controller by checking if the combustion quality is inside or outside a defined combustion quality range. When the combustion quality is inside the defined combustion quality range, the mixing ratio of gas and air of the gas/air mixture is not changed. When the combustion quality is outside the defined combustion quality range, the mixing ratio of gas and air of the gas/air mixture is changed by adjusting a gas throttle to compensate for tolerances of the pneumatic controller and/or for a potentially changing behavior of the pneumatic controller.

11 Claims, 6 Drawing Sheets

(51) Int. Cl.
*F23N 1/02* (2006.01)
*F23N 5/12* (2006.01)

(52) U.S. Cl.
CPC ..... *F23N 2027/20* (2013.01); *F23N 2033/08* (2013.01); *F23N 2900/05181* (2013.01)

(56) References Cited

FOREIGN PATENT DOCUMENTS

| | | | | | |
|---|---|---|---|---|---|
| EP | 0652501 | | 5/1995 | | |
| EP | 0833106 | | 11/2001 | | |
| EP | 2667097 | | 11/2013 | | |
| EP | 2685169 | A1 * | 1/2014 | ..... | F23N 1/022 |
| WO | 2013140219 | | 9/2013 | | |

* cited by examiner

METHOD FOR OPERATING A GAS BURNER

This application claims priority to European Patent Application No. 15 160 313.1, filed Mar. 23, 2015, which is incorporated herein by reference.

The present patent application relates to a method for operating a gas burner.

EP 2 667 097 A1 discloses a method for operating a gas burner. During burner-on phases a defined gas/air mixture having a defined mixing ratio of gas and air is provided to a burner chamber of the gas burner for combusting the defined gas/air mixture within the burner chamber. The defined gas/air mixture is provided by a mixing device mixing an air flow provided by an air duct with a gas flow provided by a gas duct. The air flow flowing through the air duct is provided by fan in such a way that the fan speed of the fan depends on a desired burner load of the gas burner, wherein the fan speed range of the fan defines a modulation range of the gas burner.

According to EP 2 667 097 A1 the defined mixing ratio of gas and air of the gas/air mixture is kept constant over the entire modulation range of the gas burner by a pneumatic controller. The pneumatic controller using a pressure difference between the gas pressure of the gas flow in the gas pipe and a reference pressure, wherein either the air pressure of the air flow in the air duct or the ambient pressure is used as reference pressure, and wherein the pressure difference between the gas pressure of the gas flow in the gas pipe and the reference pressure is determined and controlled pneumatically. The combustion quality is monitored on basis of a signal provided by a combustion quality sensor like a flame ionization sensor.

During burner-on phases the mixing ratio of the gas/air mixture can be calibrated to different gas qualities on basis of the signal provided by the flame ionization sensor. The flame ionization sensor is used to calibrate the gas/air mixture to different gas qualities. The control of the mixing ratio of the gas/air mixture over the modulation range of the gas burner is independent from the flame ionization current.

As mentioned above, EP 2 667 097 A1 discloses a method for operating a gas burner in which the defined mixing ratio of the gas/air mixture is kept constant over the entire modulation range of the gas burner. Only during a calibration mode the mixing ratio of the gas/air mixture can be changed to compensate for a changing gas quality. However, after a calibration has been executed, the mixing ratio of the gas/air mixture is kept constant over the entire modulation range of the gas burner.

The calibration disclosed by EP 2 667 097 A1 can only be performed in a certain subrange of the modulating range of the gas burner close to full-load operation of the same, preferably between 50% (corresponds to a modulation of "2") and 100% (corresponds to a modulation of "1") of full burner load operation. Outside of said subrange the calibration is not reliable.

The method of EP 2 667 097 A1 allows a stable and reliable control of the gas burner within a modulation range of 1:5, wherein a modulation of "1" means that the fan is operated at 100% of maximum fan speed and a modulation of "5" means that the fan is operated at 20% of maximum fan speed. Below a modulation range of "5", meaning for fan speeds below 20% of maximum fan speed, the method known from prior art is not accurate enough. One reason for that is that tolerances in the behaviour of the pneumatic controller or a change of the behaviour of the pneumatic controller over the life time of the same have a big impact to the control quality at fan speeds below 20% of maximum fan speed.

Against this background a method for operating a gas burner is provided which allows an accurate control of a gas burner in a broader modulation range, preferably in a modulation range of 1:8 or 1:10, wherein a modulation of "8" means that the fan is operated at 12.5% of maximum fan speed, and wherein modulation of "10" means that the fan is operated at 10% of maximum fan speed.

The present application provides a method for operating a gas burner according to claim 1. According to the present invention, the signal provided by the combustion quality sensor is used to detect tolerances of the pneumatic controller and/or a potentially changing behaviour of the pneumatic controller by checking if the combustion quality is inside or outside a defined combustion quality range. When the combustion quality is inside the defined combustion quality range so that no tolerances of the pneumatic controller and no changing behaviour of the pneumatic controller is detected, the mixing ratio of gas and air of the gas/air mixture is kept constant. When the combustion quality is outside the defined combustion quality range so that tolerances of the pneumatic controller and/or a changing behaviour of the pneumatic controller is detected, the mixing ratio of gas and air of the gas/air mixture is changed by adjusting a setting of a gas throttle positioned within the gas duct so that influences of tolerances of the pneumatic controller and/or of a potentially changing behaviour of the pneumatic controller become compensated to broaden the modulation range. The method of the present invention allows an accurate control of the gas burner in a broader modulation range, especially in a modulation range of 1:8 or 1:10. The method of the present invention is can be executed over the entire modulation range of the gas burner or over a subrange of the modulation range. The present invention does not relate to a calibration routine to compensate for a changing gas quality which can only be executed within a certain subrange of the modulation range of the gas burner. The method of the present invention can be executed over the entire modulation range of the gas burner to compensate tolerances in the behaviour of the pneumatic controller and/or a change of the behaviour of the pneumatic controller over the life time of the same.

Preferably, the signal provided by the combustion quality sensor is used permanently, e.g. at defined fan speeds, to detect tolerances of the pneumatic controller and/or a changing behavior of the pneumatic controller and to compensate the same. When, the combustion quality is outside the defined combustion quality range, the setting of the gas throttle is adjusted on basis of a pre-learned and/or adaptive compensation curve.

According to a preferred further development of the present invention, the modulation range of the gas burner is defined by an upper fan speed and a lower fan speed, wherein the modulation range is divided in a first subrange defined by the upper fan speed and an intermediate fan speed and in a second subrange defined by the intermediate fan speed and the lower fan speed. The gas burner is controlled in such a way that for a heat demand requiring a fan speed within the first subrange of the modulation range, the mixing ratio of the gas/air mixture is kept constant over the first subrange of the modulation range and the fan speed is changed to the desired fan load within the first subrange of the modulation range of the gas burner. For a heat demand requiring a fan speed within the second subrange of the modulation range, the combustion quality is checked at the intermediate fan speed or at a fan speed depending from the intermediate fan speed. When the combustion quality at said fan speed is inside a defined combustion quality range, the mixing ratio of the gas/air mixture is kept constant, and the fan speed is changed to the desired fan load within the second subrange of the modulation range of the gas burner. When the combustion quality at said fan speed is outside the defined combustion quality range, the mixing ratio of the gas/air mixture is changed by adjusting a setting of a gas throttle positioned within the gas duct so that influences of tolerances of the pneumatic controller and/or of a potentially changing behaviour of the pneumatic controller become compensated, and the fan speed is changed to the desired fan load within the second subrange of the modulation range of the gas burner. This allows an accurate control of the gas burner in a broader modulation range, especially an accurate and fast modulation in a modulation range of 1:8 or 1:10.

Preferably, the combustion quality is monitored permanently at least when the fan speed of the fan is within the second subrange of the modulation range. When the combustion quality gets outside of the defined combustion quality range while the fan speed is changed within the second subrange, the mixing ratio of gas and air of the gas/air mixture is changed by adjusting the setting of the gas throttle so that the combustion quality returns to the defined combustion quality range. The setting of the gas throttle which is needed so that the combustion quality returns to the defined combustion quality range is stored in order to provide a throttle setting value for future heat demands which require a fan speed within the second subrange of the modulation range. This allows an accurate and fast control of the gas burner in a broader modulation range, especially in a modulation range of 1:8 or 1:10.

Preferred developments of the invention are provided by the dependent claims and the description which follows. Exemplary embodiments are explained in more detail on the basis of the drawing, in which:

FIG. 1 shows a schematic view of a gas burner appliance 10.

Figure 1:
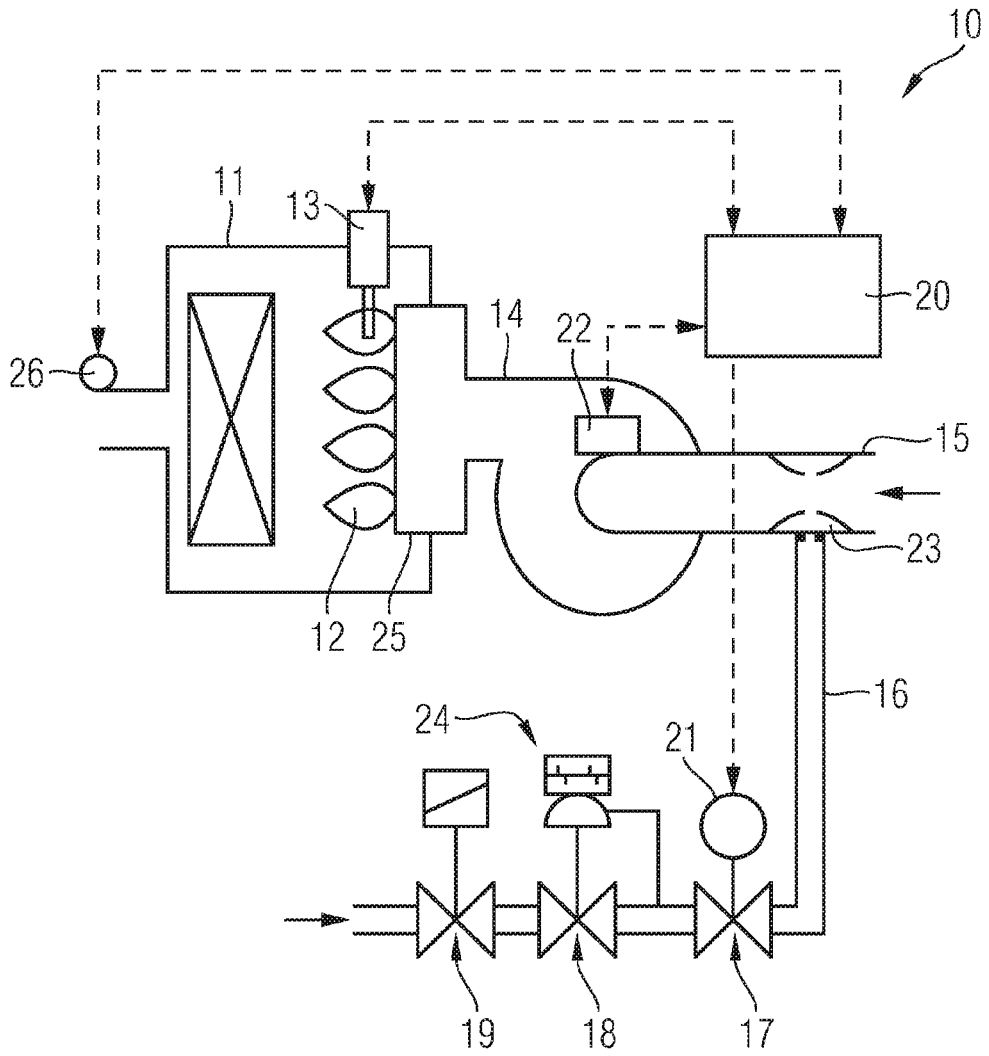
FIG. 1 shows a schematic view of a gas burner known from prior art.

The gas burner appliance 10 comprises a gas burner providing a gas burner chamber 11 with a gas burner surface 25 in which combustion of a defined gas/air mixture having a defined mixing ratio of gas and air takes place during burner-on phases of the gas burner. The combustion of the gas/air mixture results into flames 12 monitored by a flame ionization sensor 13.

The defined gas/air mixture is provided to the burner chamber 11 of the gas burner by mixing an air flow with a gas flow. A fan 14 sucks in air flowing through an air duct 15 and gas flowing though a gas duct 16. A gas regulating valve 18 for adjusting the gas flow through the gas duct 16 and a gas safety valve 19 are assigned to the gas duct 16.

The defined gas/air mixture having the defined mixing ratio of gas and air is provided to the burner chamber 11 of the gas burner. The defined gas/air mixture is provided by mixing the air flow provided by an air duct 15 with a gas flow provided by a gas duct 16. The air flow and the gas flow become preferably mixed by a mixing device 23. Such a mixing device can be designed as a so-called Venturi nozzle.

The quantity of the air flow and thereby the quantity of the gas/air mixture flow is adjusted by the fan 14, namely by the fan speed of the fan 14. The fan speed can be adjusted by an actuator 22 of the fan 14. The fan speed of the fan 14 is controlled by a controller 20 generating a control variable for the actuator 22 of the fan 14. The controller 20 determines the control variable for the actuator 22 and thereby the desired fan speed on basis of an actual heat demand of the gas burner appliance 10.

By changing the fan speed of the fan 14 the load of the gas burner can be adjusted.

The actual fan speed of the fan 14 sets the actual modulation of the gas burner. A modulation of "1" means that the fan 14 is operated at a maximum fan speed and thereby at full burner load of the gas burner. A modulation of "5" means that the fan 14 is operated at 20% of the maximum fan speed and a modulation of "10" means that the fan 14 is operated at 10% of the maximum fan speed.

The defined mixing ratio of the defined gas/air mixture is controlled by the gas regulating valve 18, namely by a pneumatic controller 24 acting the same. The pneumatic controller 24 of the gas regulating valve 18 controls the opening/closing position of the gas valve 18. The valve position of the gas valve 18 is adjusted by the pneumatic controller 24 on basis of a pressure difference between the gas pressure of the gas flow in the gas pipe 16 and a reference pressure. The gas regulating valve 18 is controlled by the pneumatic controller 24 in such a way that at the outlet of the gas valve 18 the pressure is equal to the reference pressure. In FIG. 1, the ambient pressure serves as reference pressure. However, it is also possible to use the air pressure of the air flow in the air duct 15 as reference pressure. The pressure to difference between the gas pressure and the reference pressure is determined pneumatically by pneumatic sensor of the pneumatic controller 24.

During burner-on phases the defined mixing ratio of gas and air of the defined gas/air mixture can be calibrated to different gas qualities. The calibration is performed by adjusting a setting of a throttle 17. The throttle setting can be adjusted by an actuator 21. The controller 20 controls the actuator 21 and thereby the setting of the throttle 17. The calibration can be performed at selected times, namely immediately after installation of the gas burner and/or immediately after restart of the gas burner and/or immediately after a reset of the gas burner.

The calibration is be performed in a modulating range of the gas burner close to full-load operation of the same, preferably between 50% (corresponds to a modulation of "2") and 100% (corresponds to a modulation of "1") of full burner load operation. Details of the calibration are disclosed by EP 2 667 097 A1.

As mentioned above, the actual fan speed of the fan 14 defines the actual modulation of the gas burner. The gas burner appliance 10 can be operated within a defined modulation range. The modulation range of the gas burner is defined by an upper fan speed which preferably is the maximum fan speed and a lower fan speed.

As also mentioned above, the combustion of the gas/air mixture results into flames 12 monitored by a flame ionization sensor 13. The signal provided by the flame ionization sensor 13 can be used to monitor the combustion quality, especially by monitoring the so-called $\lambda$ value. In addition or alternatively, the combustion quality can be monitored by an exhaust gas sensor 26. The exhaust gas sensor 26 can be an $O_2$-sensor or CO-sensor.

Figure 2:
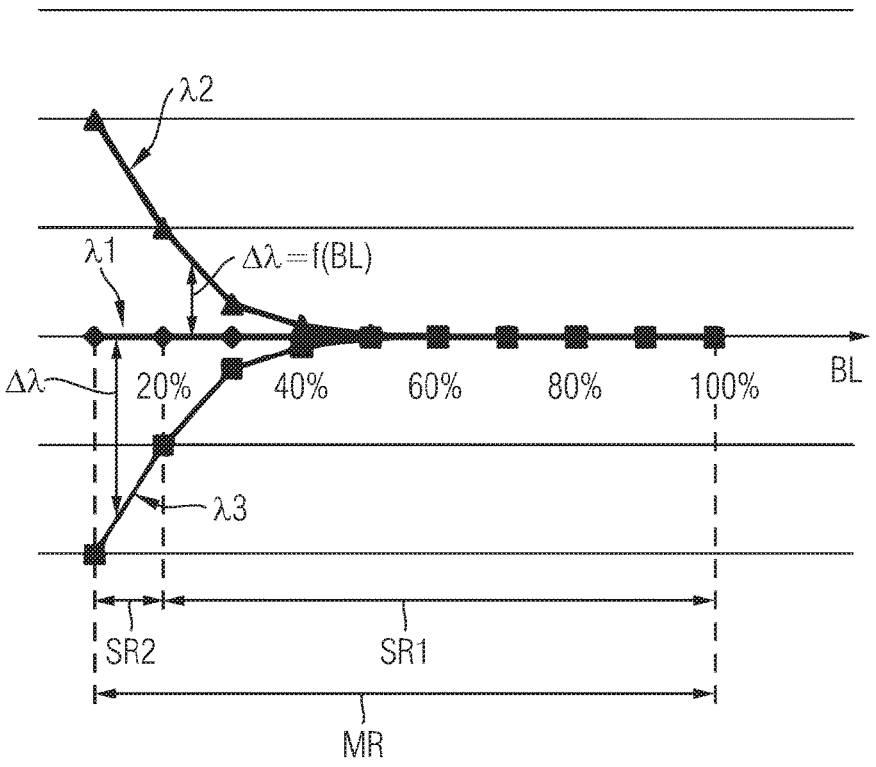
FIG. 2 shows a diagram illustrating problems of the prior art method for operating a gas burner.

As shown in FIG. 2, the combustion quality—here illustrated by the so-called λ value—may change over the modulation range of the gas burner as a function of the desired burner load BL. The curve λ1 illustrates an ideal behaviour of the gas/air control. However, in reality most likely there will be an offset Δλ from that ideal behaviour. FIG. 2 shows potential curves λ2, λ3 illustrating a potential real behaviour of the gas/air control due to tolerances of the pneumatic controller 24 and/or due to a potentially changing behaviour of the pneumatic controller 24. The offset Δλ depends from the burner load BL meaning that Δλ=f(BL). As shown in FIG. 2, tolerances of the pneumatic controller 24 and/or the potentially changing behaviour of the pneumatic controller 24 can have a big impact to the combustion quality at the lower end of the modulation range, especially for fan speeds below 20% of maximum fan speed (corresponds to a modulation of "5").

In an upper range of the modulation range, especially for fan speeds between e.g. 20% of maximum fan speed (corresponds to a modulation of "5") and 100% of maximum fan speed (corresponds to a modulation of "5"), the offset Δλ between the curves λ1, λ2 or the curves λ1, λ3 is small enough to still provide a good combustion quality. However, when the offset Δλ between the curves λ1, λ2 or the curves λ1, λ3 becomes bigger at fan speeds below e.g. 20% of maximum fan speed, said offset Δλ may result in a bad combustion quality. This is the reason why gas burner control methods known from prior art usually do not expand the modulation range below a modulation of "5" and why the calibration is performed in a modulating range close to full burner load operation.

According to the present invention, the signal provided by the combustion quality sensor, especially by the flame ionization sensor 13, is used to detect tolerances of the pneumatic controller 24 and/or a potentially changing behaviour of the pneumatic controller 24 by checking if the combustion quality signal is inside or outside a defined combustion quality range, especially by checking if the offset Δλ is below or above a defined threshold. When the combustion quality is inside the defined combustion quality range—e.g. the offset Δλ is below the defined threshold—so that no tolerances of the pneumatic controller 24 and/or no changing behaviour of the pneumatic controller is detected, the mixing ratio of gas and air of the gas/air mixture is kept constant. When the combustion quality is outside the defined combustion quality range—e.g. the offset Δλ is above the defined threshold—so that tolerances of the pneumatic controller 24 and/or a changing behaviour of the pneumatic controller is detected, the mixing ratio of gas and air of the gas/air mixture is changed by adjusting a setting of the gas throttle 17 positioned within the gas duct 16 so that influences of tolerances of the pneumatic controller 24 and/or of a potentially changing behaviour of the pneumatic controller 24 become compensated to broaden the modulation range.

When the combustion quality changes almost uniformly over the modulation range of the gas burner or the observed portion of the same, a change of the gas quality is detected.

However, when the combustion quality changes non-uniformly over the modulation range of the gas burner or the observed portion of the same, especially when the combustion quality changes only over a lower subrange of the modulation range, a change in the behaviour of the pneumatic controller 24 is detected.

The compensation of tolerances of the pneumatic controller 24 and/or of a potentially changing behaviour of the pneumatic controller 24 as a function of the signal provided by the combustion quality sensor, especially by the flame ionization sensor 13, is preferably performed over the entire modulation range of the gas burner.

It is possible to check the combustion quality at defined fan speeds within the modulation range of the gas burner. When the combustion quality at the respective fan speed is inside the defined combustion quality range, the mixing ratio of gas and air of the gas/air mixture is kept constant at least for said fan speed. When the combustion quality at the respective fan speed is outside the defined combustion quality range, the mixing ratio of gas and air of the gas/air mixture is changed at least for said fan speed by adjusting the setting of the gas throttle 17 positioned within the gas duct 16 so that the influences of tolerances of the pneumatic controller 24 and/or of a potentially changing behaviour of the pneumatic controller 24 become compensated at least for said fan speed.

When the combustion quality is outside the defined combustion quality range, the setting of the gas throttle 17 is adjusted on basis of a pre-learned and/or adaptive compensation curve stored in the controller 20.

As mentioned above, the compensation of tolerances of the pneumatic controller 24 and/or of a potentially changing behaviour of the pneumatic controller 24 as a function of the signal provided by the combustion quality sensor is preferably performed over the entire modulation range of the gas burner.

When the combustion quality gets outside of the defined combustion quality range, e.g. the offset Δλ gets above the defined threshold, the mixing ratio of gas and air of the gas/air mixture is changed by adjusting the setting of the gas throttle 17 so that the combustion quality returns to the defined combustion quality range, e.g. so that the offset Δλ returns below the defined threshold. The setting of the gas throttle 17 which is needed so that the combustion quality returns to the defined combustion quality range is stored together with the respective fan speed/burner load to provide a respective throttle setting value for future heat demands. In this way it is possible to automatically learn a compensation curve and/or to automatically adapt a compensation curve which provides for certain fan speeds/burner loads certain throttle setting values.

If for a new heat demand the combustion quality gets outside of the defined combustion quality range, it is checked if the stored and/or adapted compensation curve provides for the respective fan speed/burner load a respective throttle setting value for compensation. If this is the case, the throttle setting value of the stored curve will be used. If this is not the case, a throttle setting value for that fan speed/burner load will be determined by interpolation and/or extrapolation of the stored curve.

The stored setting value or the setting value determined by interpolation and/or extrapolation is then used to adjust the setting of the gas throttle 17. If the combustion quality returns to the defined combustion quality range, the used setting value is in good order and the same can eventually be used adapt the stored compensation curve. If the combustion quality does not return to the defined combustion quality range, the used setting value is not in good order and the same will be amended so that the combustion quality returns to the defined combustion quality range. That amended setting value will be used to adapt the he stored compensation curve.

According to a preferred embodiment, especially to provide fast and accurate modulation, the modulation range MR is divided in a first subrange SR1 defined by the upper fan speed—which preferably is the maximum fan speed—and an intermediate fan speed and in a second subrange SR2 defined by the intermediate fan speed and the lower fan speed. In an exemplary embodiment (see FIG. 2), the upper fan speed is 100% of the maximum fan speed, the lower fan speed is 10% of the maximum fan speed and the intermediate fan speed is 20% of the maximum fan speed. The values for the lower fan speed and the intermediate fan speed are of exemplary nature only.

Alternatively, the upper fan speed is 100% of the maximum fan speed, the lower fan speed may be 12.5% of the maximum fan speed and the intermediate fan speed may be 20% of the maximum fan speed. Alternatively, the upper fan speed is 100% of the maximum fan speed, the lower fan speed may be 8% or 10% or 12.5% or 15% of the maximum fan speed and the intermediate fan speed may be 18% or 25% or 30% or 35% or 40% of the maximum fan speed. The intermediate fan speed and the minimum fan speed can be freely chosen.

Preferably, the intermediate fan speed becomes learned and/or adapted when observing the combustion quality while modulating the fan speed and thereby modulating burner load. The intermediate fan speed preferably corresponds to the fan speed where the offset $\Delta\lambda$ is at a defined threshold. At that threshold combustion quality is still acceptable. Below that threshold for the offset $\Delta\lambda$ combustion quality is good. Above that threshold the offset $\Delta\lambda$ combustion quality is not acceptable.

The gas burner appliance 10 is preferably controlled in such a way that for a desired heat demand or desired burner load requiring a fan speed within the first subrange SR1 of the modulation range MR, the mixing ratio of the gas/air mixture is kept constant over the first subrange SR1 of the modulation range MR and the fan speed of the fan 14 is changed to the desired fan speed within the first subrange SR1 of the modulation range MR of the gas burner.

Further on, the gas burner appliance 10 is preferably controlled in such a way that for a desired heat demand or desired burner load requiring a fan speed within the second subrange SR2 of the modulation range MR, the combustion quality is checked at the intermediate fan speed or at a fan speed depending from the inter-mediate fan speed. This fan speed is hereinafter called combustion-quality-check-fan-speed.

If the combustion quality at said combustion-quality-check-fan-speed is inside a defined combustion quality range—meaning that the offset $\Delta\lambda$ is below the defined threshold—so that tolerances and no changing behaviour of the pneumatic controller is detected, the mixing ratio of the gas/air mixture is kept constant, and the fan speed is changed to the desired fan speed within the second subrange SR2 of the modulation range MR of the gas burner.

However, if the combustion quality at said combustion-quality-check-fan-speed is outside the defined combustion quality range—meaning that the offset $\Delta\lambda$ is above the defined threshold—so that tolerances and/or a changing behaviour of the pneumatic controller is detected, the mixing ratio of the gas/air mixture is changed by adjusting the setting of the gas throttle 17 positioned within the gas duct 16 so that influences of a changing behaviour of the pneumatic controller 24 become compensated, and the fan speed of the fan 14 is changed to the desired fan speed within the second subrange SR2 of the modulation range MR of the gas burner.

Figure 3:
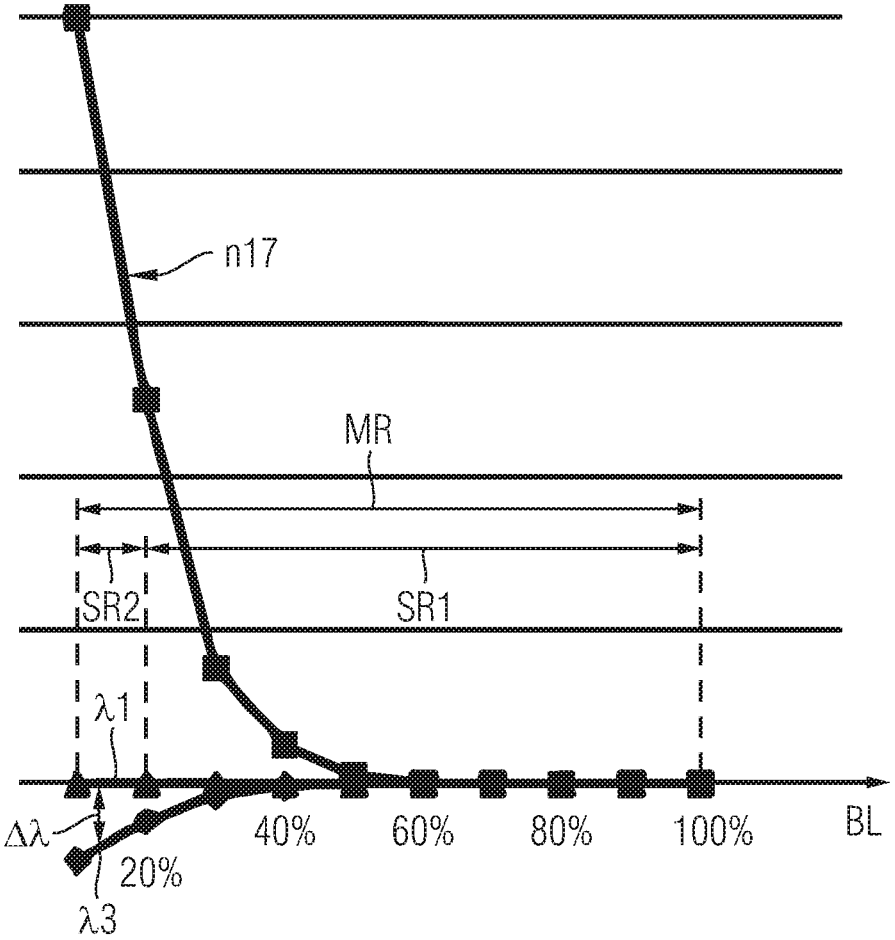
FIG. 3 shows a diagram illustrating the inventive method for operating a gas burner.

In FIG. 3 the curve $\lambda$1 illustrates an ideal behaviour of the gas/air control and the curve $\lambda$3 illustrates a real behaviour of the gas/air control due to tolerances in the behaviour of the pneumatic controller 24. An offset $\Delta\lambda$ between the curve $\lambda$1 and the curve $\lambda$3 is determined when the combustion quality is checked at the combustion-quality-check-fan-speed—in the shown embodiment at 20% of the maximum fan speed.

FIG. 3 further shows an exemplary curve n17 illustrating the change of the setting of the throttle 17 which is necessary to compensate the offset between the curve $\lambda$1 and the curve $\lambda$3 so that the combustion quality is within the desired combustion quality range. The curve n17 illustrates the number of setting steps which are needed when changing the throttle setting so that the offset between the curves $\lambda$1 and $\lambda$3 becomes compensated.

So, when a heat demand occurs which requires a fan speed within the second subrange SR2 of the modulation range MR, the combustion quality is checked preferably at the intermediate fan speed—in the shown embodiment at 20% of the maximum fan speed.

It is checked if the real combustion quality illustrated in FIG. 3 by the curve $\lambda$3 differs from the ideal combustion quality illustrated by the curve $\lambda$1. If the real combustion quality differs from the ideal combustion quality in such a way that the real combustion quality is outside the defined combustion quality range which corresponds to a threshold for the offset $\Delta\lambda$ the mixing ratio of the gas/air mixture is changed by adjusting the setting of the gas throttle 17 according to the curve n17 which is a function of the burner load BL and therefore of the desired fan speed. With that change of the throttle setting influences of the tolerances/aging in the behaviour of the pneumatic controller 24 become compensated so that the real combustion quality follows the ideal combustion quality or so that acceptable combustion quality is provided.

The curve n17 can be determined upfront and can be stored within the controller 20. It is also possible to learn the curve n17 and/or adapt the curve n17 during the operation of the gas burner.

The above method allows a safe and reliable compensation of manufacturing tolerances of the pneumatic controller 24 and of a changing behaviour of the pneumatic controller 24 over the life time and therefore aging of the gas burner appliance 10. Especially, the above method provides a fast and accurate modulation making use of the compensation of manufacturing tolerances of the pneumatic controller 24.

Within the first subrange SR1 of the modulation range MR, the fan speed of the fan is changed relative rapidly. Within the second subrange SR2 of the modulation range MR, the fan speed of the fan 14 is changed relative slowly.

The combustion quality is monitored permanently at least when the fan speed of the fan is within the second subrange SR2 of the modulation range MR. Preferably, the combustion quality is also monitored permanently when the fan speed is within the first subrange SR1 of the modulation range MR.

When the combustion quality gets outside of the defined combustion quality range while the fan speed of the fan 14 is changed within the second subrange SR2 of the modulation range MR, the mixing ratio of the gas/air mixture becomes changed by adjusting the setting of the gas throttle 17 so that the combustion quality returns to the defined combustion quality range. The setting or setting change of the gas throttle 17 which is needed so that the combustion quality returns the defined combustion quality range is stored in order to provide a throttle setting value for future heat demands which require a fan speed within the second subrange of the modulation range.

When for a future heat demand within the second subrange SR2 of the modulation range MR a stored throttle setting value is not sufficient to return the combustion quality to the defined combustion quality range, a change in the behaviour of the pneumatic controller 24 is detected and the stored throttle setting value is adjusted.

Figure 4:
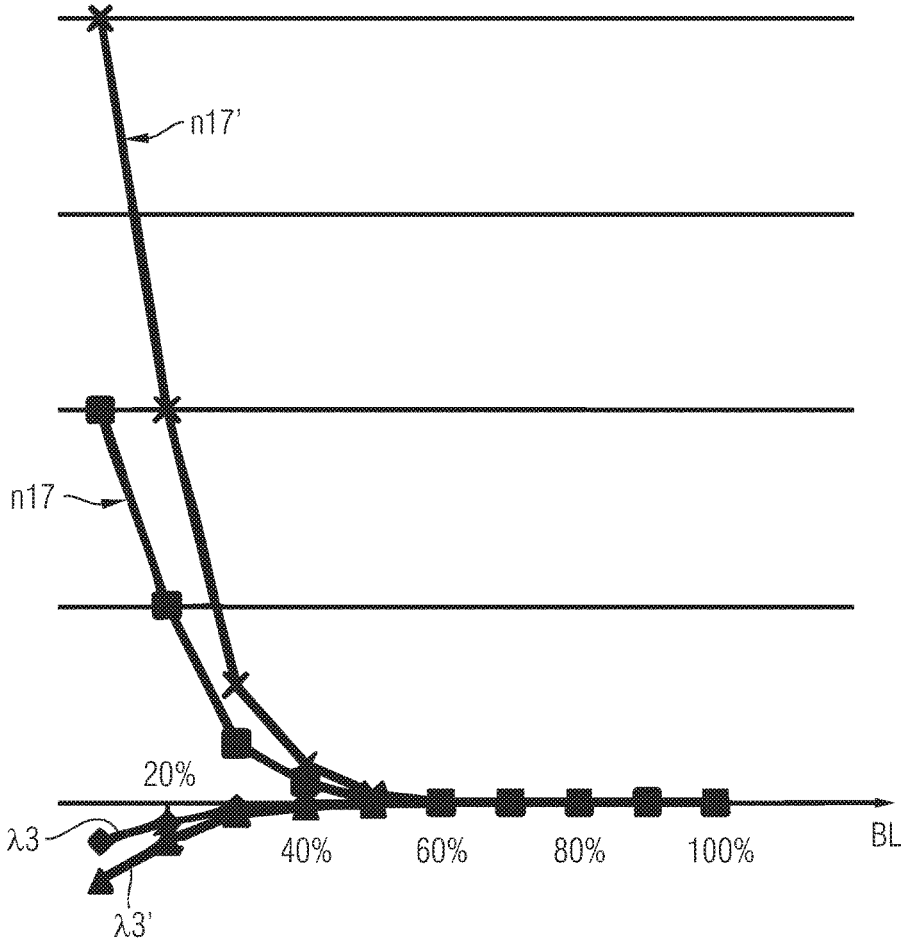
FIG. 4 shows a further diagram illustrating the inventive method for operating a gas burner.

FIG. 4 shows the curves λ3 and n17 of FIG. 3 and in addition curves λ3' and n17'. The curve n17 illustrates the throttle setting/throttle setting change needed to compensate the behaviour of curve λ3 during an actual heat demand. For a new heat demand the behaviour of gas appliance has changed resulting in a combustion quality according to curve λ3'. For a combustion quality according to curve λ3' the curve n17 adapted and/or learned for combustion quality according to curve λ3 is not appropriate. So, when during the check of combustion quality at the combustion-quality-check-fan-speed it is detected that the combustion quality has changed e.g. from curve λ3 to curve λ3', the stored curve n17 representing the throttle setting values for a combustion quality according to curve λ3 becomes automatically adjusted into curve n17'. This can be done automatically by the controller 20 using an extrapolation and/or interpolation method.

Preferably, the combustion quality is monitored permanently when the fan speed of the fan 14 is within the first and second subrange of the modulation range.

When the combustion quality is outside the defined combustion quality range, the mixing ratio of gas and air of the gas/air mixture is changed by adjusting the setting of the gas throttle 17 and the combustion quality is monitored. The change of the setting of the gas throttle 17 which is needed so that the combustion quality returns to the defined combustion quality range is stored in order to provide throttle setting values for future heat demands.

If the combustion quality changes almost uniformly over the modulation range of the gas burner, a change of the gas quality is detected and the throttle setting values are shifted parallel over the entire modulation range of the gas burner.

Figure 5:
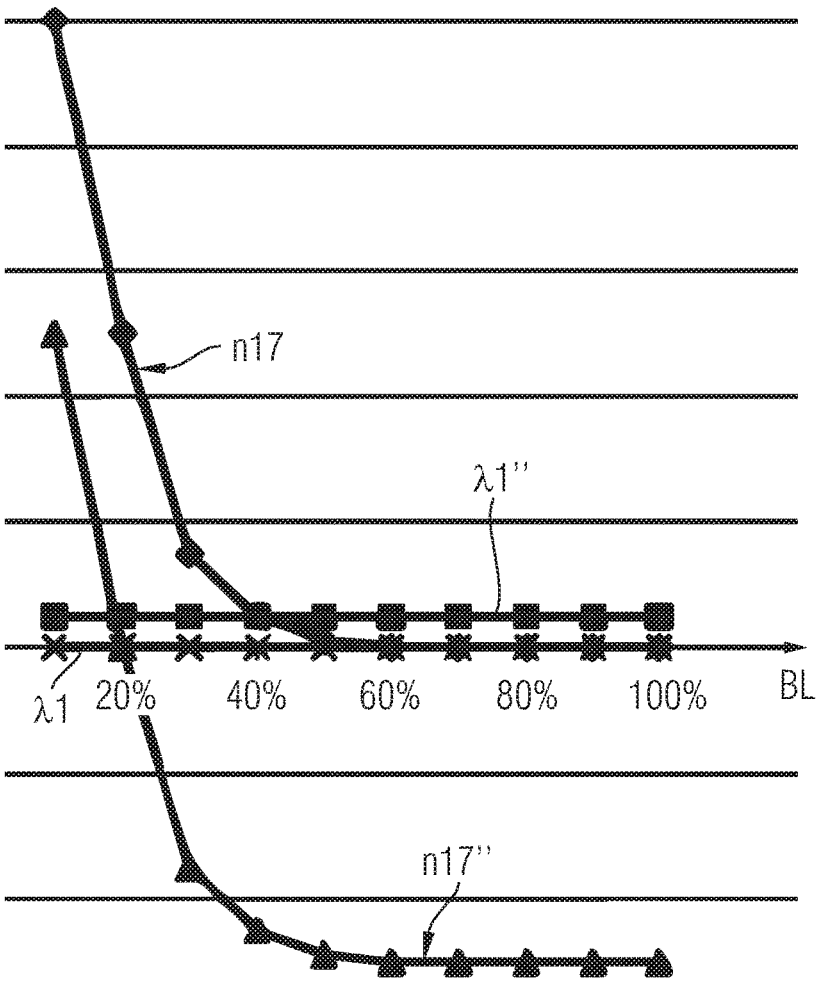
FIG. 5 shows a further diagram illustrating the inventive method for operating a gas burner.

FIG. 5 shows the curves λ1 and n17 of FIG. 3 and in addition curves λ1" and n17". The curve n17 illustrates the throttle setting/throttle setting change needed to compensate the behaviour of curve λ3 (not shown in FIG. 5) during an actual heat demand so that the combustion quality according to curve λ1 can be provided. For a new heat demand the behaviour of gas appliance has changed resulting in a combustion quality according to curve λ1". The curve λ1" runs almost parallel to the curve λ1. This is interpreted by the controller 20 as a change in the gas quality. For the combustion quality according to curve λ1" the curve n17 is not appropriate. So, when it is detected that the combustion quality has changed e.g. from curve to curve λ1", the stored curve n17 becomes automatically adjusted, namely parallel shifted, into curve n17". This can be done automatically by the controller 20.

Figure 6:
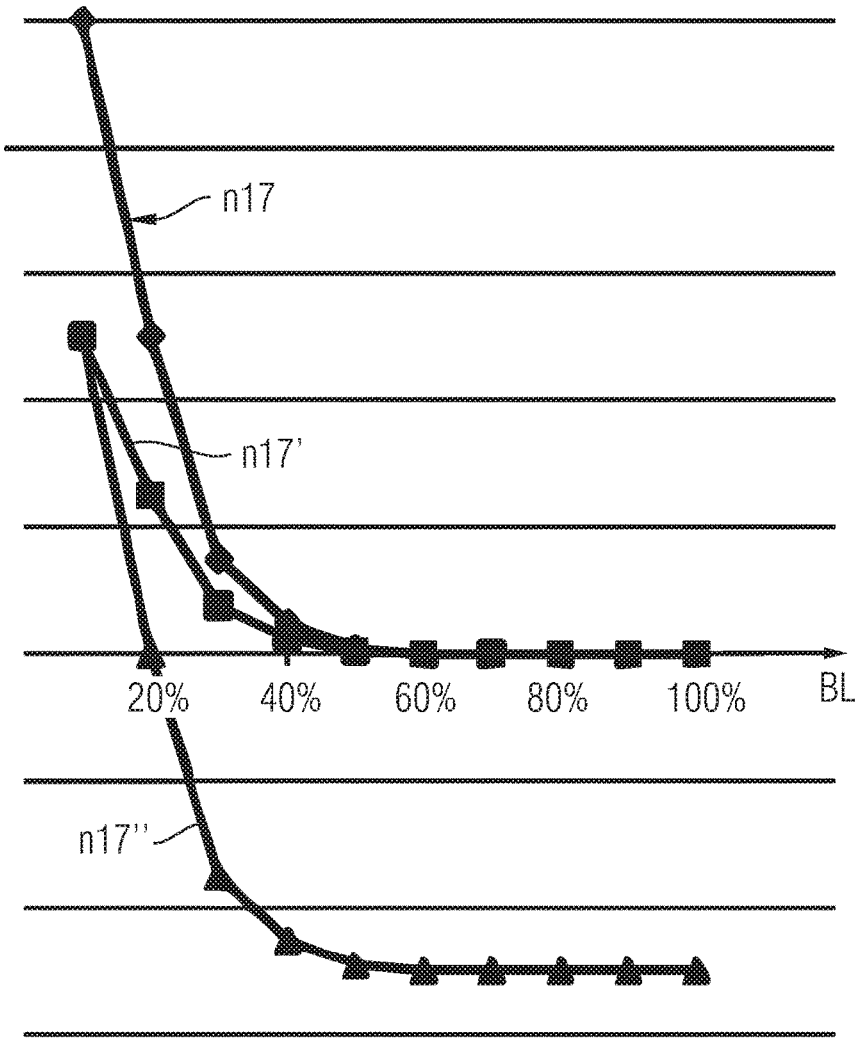
FIG. 6 shows a further diagram illustrating the inventive method for operating a gas burner.

FIG. 6 shows the curves n17, n17' of FIG. 4 as well as the curves n17, n17" of FIG. 5 combined in one diagram. The curve n17 has been learned to compensate the offset between combustion quality curves λ1 and λ3. The curve n17' illustrates the change of curve n17 caused by a change in the behaviour of the pneumatic controller 24. The curve n17" illustrates the change of curve n17 caused by a gas quality change.

The invention proposes to use a pneumatic 1:1 gas air controller 24 to control the mixing ratio of gas and air of the gas/air mixture. A throttle 17 driven by a motor 21 is used to compensate for tolerances and aging effects of the pneumatic controller 24. The gas air control by pneumatic controller 24 and modulation/burner load is set by the speed of the fan 14 are based on air supply/fan speed. The throttle setting of throttle 17 is set for nominal λ1 at the current gas type.

In the operating range of the pneumatic controller 24 the combustion quality is monitored and in case of deviation the controller 20 decides automatically to correct the setting of the throttle 17 to the provided the desired combustion quality.

For relatively low burner loads requiring a fan speed within the second subrange of the modulation range, the combustion quality is checked at a defined combustion-quality-checkfan-speed, especially by analysing the signal (λ signal) provided by the ionization sensor 13 or by analysing the signal provided by the exhaust gas sensor 26. If the combustion quality still is nominal within a defined quality range, the fan 14 can drive to lower fan speeds below the combustion-quality-check-fan-speed thereby driving the gas burner to lower loads within the second modulation subrange SR2 without correction of the throttle 17 while continuing to monitor the gas quality. However, if the combustion quality is not nominal at the combustion-quality-check-fan-speed (.e.g. the λ signal is too high or too low), a correction to the throttle setting is made to be able to drive the fan speed below the combustion-quality-check-fan-speed. The correction of the throttle setting can be calculated/predicted. This calculation can be done based self-learning and storing, but also based on a formula. The throttle setting for the required combustion quality can be stored modulating down relatively slowly to let time for accurate combustion quality measurement (e.g. λ measurement by ionization sensor 13) and correction.

When modulating up from a fan speed within the second subrange SR2 of the modulation range MR, the throttle movement can be predicted using the stored throttle position in relation to the fan speed or by using theoretical prediction/calculation. This ensures reliable and fast modulation.

This invention allows us to extend the limits of pneumatic control with fast modulation and limited movement of throttle. A modulating range of 1:8 or even of 1:10 can be realized.

The difference between gas quality change and change in the behaviour of the pneumatic controller 24 can be determined by checking the combustion quality feedback again at another load: In case both measurements indicate a parallel shift, it was a gas quality change and rest of the curve can be shifted parallel (see FIG. 4). In case the shape of the curve n17 changes, it was a change in the behaviour of the pneumatic controller 24, and rest of the curve can be scaled accordingly.

The combustion quality feedback provided by sensor 13 and/or sensor 26 is assumed to be fail-safe and in case of need, can be tested for its correctness.

SUMMARY

Method for operating a gas burner, wherein during burner-on phases a defined gas/air mixture having a defined mixing ratio of gas and air is provided to a burner chamber (11) of the gas burner for combusting the defined gas/air mixture within the burner chamber (11). Said defined gas/air mixture is provided by a mixing device (23) mixing an air flow provided by an air duct (15) with a gas flow provided by a gas duct (16). Said air flow flowing is provided by fan (14) in such a way that the fan speed of the fan (14) depends on a desired burner load of the gas burner, wherein the fan speed range of the fan (14) defines a modulation range of the gas burner. Said mixing ratio of gas and air of the gas/air mixture is controlled over the modulation range of the gas burner by a pneumatic controller (24) on basis of a pressure difference between the gas pressure of the gas flow in the gas pipe (16) and a reference pressure, wherein either the air pressure of the air flow in the air duct (15) or the ambient pressure is used as reference pressure, and wherein the pressure difference between the gas pressure and the reference pressure is determined and controlled pneumatically. During burner on phases the combustion quality is monitored on basis of a signal provided by a combustion quality sensor like a flame ionization sensor (13) or an exhaust gas sensor (26). The signal provided by the combustion quality sensor is used to detect tolerances of the pneumatic controller (24) and/or a potentially changing behaviour of the pneumatic controller (24) by checking if the combustion quality is inside or outside a defined combustion quality range; wherein when the combustion quality is inside the defined combustion quality range, the mixing ratio of gas and air of the gas/air mixture is kept constant; and wherein when the combustion quality is outside the defined combustion quality range, the mixing ratio of gas and air of the gas/air mixture is changed by adjusting a setting of a gas throttle (17) positioned within the gas duct (16) so that influences of tolerances of the pneumatic controller (24) and/or of a potentially changing behaviour of the pneumatic controller (24) become compensated to broaden the modulation range.

LIST OF REFERENCE SIGNS

10 gas burner appliance
11 gas burner chamber
12 flame
13 flame ionization sensor
15 air duct
16 gas duct
17 throttle
18 gas valve/regulating valve
19 gas valve/safety valve
20 controller
21 actuator
22 actuator
23 mixing device
24 pneumatic controller
25 gas burner surface
26 exhaust gas sensor

What is claimed is:

1. A method for operating a gas burner, wherein during burner-on phases a defined gas/air mixture having a defined mixing ratio of gas and air is provided to a burner chamber of the gas burner for combusting the defined gas/air mixture within the burner chamber;

said defined gas/air mixture is provided by a mixing device mixing an air flow provided by an air duct with a gas flow provided by a gas duct;

said air flow flowing through the air duct is provided by fan in such a way that a fan speed of the fan depends on a desired burner load of the gas burner, wherein a fan speed range of the fan defines a modulation range of the gas burner;

said defined mixing ratio of gas and air of the defined gas/air mixture is controlled over the modulation range of the gas burner by a pneumatic controller on basis of a pressure difference between a gas pressure of the gas flow in a gas pipe and a reference pressure, wherein either an air pressure of the air flow in the air duct or an ambient pressure is used as the reference pressure, and wherein the pressure difference between the gas pressure of the gas flow in the gas pipe and the reference pressure is determined and controlled pneumatically;

during burner on phases a combustion quality is monitored on basis of a signal provided by a combustion quality sensor;

the signal provided by the combustion quality sensor is used to detect tolerances of the pneumatic controller and/or a potentially changing behaviour of the pneumatic controller by checking if the combustion quality is inside or outside a defined combustion quality range;

the modulation range of the gas burner is defined by an upper fan speed and a lower fan speed, and that the modulation range is divided into a first subrange defined by the upper fan speed and an intermediate fan speed and into a second subrange defined by the intermediate fan speed and the lower fan speed;

wherein the gas burner is controlled such that for a heat demand requiring a fan speed within the first subrange of the modulation range, the defined mixing ratio of gas and air of the defined gas/air mixture is kept constant over the first subrange of the modulation range and the fan speed is changed to a desired fan speed within the first subrange of the modulation range; and for a heat demand requiring a fan speed within the second subrange of the modulation range, the combustion quality is checked at the intermediate fan speed or at a fan speed depending on the intermediate fan speed, and:

when the combustion quality at said fan speed is inside a defined combustion quality range, the defined mixing ratio of gas and air of the defined gas/air mixture is kept constant, and the fan speed is changed to the desired fan speed within the second subrange of the modulation range of the gas burner; and when the combustion quality at said fan speed is outside the defined combustion quality range, the defined mixing ratio of gas and air of the defined gas/air mixture is changed by adjusting a setting of the gas throttle positioned within the gas duct so that influences of tolerances of the pneumatic controller and/or of a potentially changing behaviour of the pneumatic controller become compensated to broaden the second subrange of the modulation range, and the fan speed is changed to the desired fan speed within the second subrange of the modulation range of the gas burner.

2. The method of claim 1, wherein when the combustion quality is outside the defined combustion quality range, the setting of the gas throttle is adjusted on basis of a pre-learned and/or adaptive compensation curve.

3. The method of claim 1, wherein the fan speed is changed faster within the first subrange of the modulation range than within the second subrange of the modulation range.

4. The method of claim 1, wherein the combustion quality is monitored at least when the fan speed is within the second subrange of the modulation range.

5. The method of claim 1, wherein when the combustion quality gets outside of the defined combustion quality range while the fan speed is changed within the second subrange, the defined mixing ratio of gas and air of the defined gas/air mixture is changed by adjusting the setting of the gas throttle so that the combustion quality returns to the defined combustion quality range, wherein the setting of the gas throttle which is needed so that the combustion quality returns to the defined combustion quality range is stored in order to provide a throttle setting value for future heat demands which require a fan speed within the second subrange of the modulation range.

6. The method of claim 5, wherein when a stored throttle setting value for a future heat demand is not sufficient to return the combustion quality to the defined combustion quality range, a change in a behaviour of the pneumatic controller is detected and the stored throttle setting value is adjusted.

7. The method of claim 1, wherein the combustion quality is monitored over at least a monitored portion of the modulation range of the gas burner.

8. The method of claim 7, wherein when the combustion quality is outside the defined combustion quality range, the defined mixing ratio of gas and air of the defined gas/air mixture is changed by adjusting the setting of the gas throttle and the combustion quality is monitored, wherein a change of the setting of the gas throttle which is needed so that the combustion quality returns to the defined combustion quality range is stored in order to provide throttle setting values for future heat demands.

9. The method of claim 8, wherein when the combustion quality changes substantially uniformly over the monitored portion of the modulation range of the gas burner, a change in a gas quality is detected.

10. The method of claim 9, wherein when a change of the gas quality is detected, the throttle setting values are shifted over the monitored portion of the modulation range of the gas burner.

11. The method of claim 7, wherein when the combustion quality changes non-uniformly over the monitored portion of the modulation range of the gas burner, especially when the combustion quality changes only over a lower subrange of the monitored portion of the modulation range, a change in a behaviour of the pneumatic controller is detected.

* * * * *